US007754665B2

(12) United States Patent
Tsuzaki et al.

(10) Patent No.: US 7,754,665 B2
(45) Date of Patent: Jul. 13, 2010

(54) LUBRICANT SOLUTION AND METHOD FOR COATING LUBRICANT

(75) Inventors: Masaaki Tsuzaki, Chiba (JP); Hidekazu Okamoto, Kanagawa (JP)

(73) Assignee: Asahi Glass Company, Limited, Tokyo (JP)

( * ) Notice: Subject to any disclaimer, the term of this patent is extended or adjusted under 35 U.S.C. 154(b) by 1111 days.

(21) Appl. No.: 11/013,388

(22) Filed: Dec. 17, 2004

(65) Prior Publication Data

US 2005/0107271 A1 May 19, 2005

Related U.S. Application Data

(63) Continuation of application No. PCT/JP03/07777, filed on Jun. 19, 2003.

(30) Foreign Application Priority Data

Jun. 20, 2002 (JP) ..... 2002-179907
Jun. 20, 2002 (JP) ..... 2002-179908

(51) Int. Cl.
*C10M 131/04* (2006.01)

(52) U.S. Cl. ..... 508/590; 508/215; 508/577; 508/583

(58) Field of Classification Search ..... 508/590
See application file for complete search history.

(56) References Cited

U.S. PATENT DOCUMENTS 4,947,881 A * 8/1990 Magid et al. ..... 134/40
5,275,669 A * 1/1994 Van Der Puy et al. ..... 134/42
5,608,002 A * 3/1997 Kubo et al. ..... 524/795
5,637,142 A * 6/1997 Kubo et al. ..... 106/285
5,667,594 A * 9/1997 Omure et al. ..... 134/26
6,841,091 B2 * 1/2005 Michaud ..... 252/194
7,053,035 B2 * 5/2006 Hanada et al. ..... 510/407

FOREIGN PATENT DOCUMENTS

| | | |
|---|---|---|
| EP | 626179 | 11/1994 |
| GB | 2358189 | 7/2001 |
| JP | 6-17096 | 1/1994 |
| JP | 6-41588 | 2/1994 |
| JP | 6-145080 | 5/1994 |
| JP | 7-18296 | 1/1995 |
| JP | 7-62394 | 3/1995 |
| JP | 7-173498 | 7/1995 |
| JP | 2002-20775 | 1/2002 |
| JP | 2002-47218 | 2/2002 |

* cited by examiner

*Primary Examiner*—Ellen M McAvoy
(74) *Attorney, Agent, or Firm*—Oblon, Spivak, McClelland, Maier & Neustadt, L.L.P.

(57) ABSTRACT

A lubricant solution and a method for coating a lubricant using a solvent which does not adversely affect the global environment and provides an excellent solubility to a fluorinated or silicon lubricant and which is little influential over a synthetic resin such as an acrylic resin or a polycarbonate resin. A lubricant solution of the present invention comprises a lubricant and a solvent which contains a nonafluorohexane.

17 Claims, No Drawings

LUBRICANT SOLUTION AND METHOD FOR COATING LUBRICANT

TECHNICAL FIELD

The present invention relates to a lubricant solution and a method for coating a lubricant.

BACKGROUND ART

Heretofore, fluorinated solvents, etc. have been used as solvents for diluting various organic substances such as lubricants, which contain as active components, perfluorocarbons (hereinafter referred to as PFC) such as trichlorotrifluoroethane (hereinafter referred to as R113), dichloropentafluoropropane (hereinafter referred to as R225) and perfluorohexane, perfluorohexyloxymethane and tridecafluorohexane, which are excellent in non-flammability and in chemical and thermal stability (JP-A-2001-262171).

However, R113 or R225 has an ozone-depleting coefficient, and PFC has a very high global warming coefficient. Thus, they respectively present adverse effects to the global environment. With respect to chlorofluorocarbons such as R113, the production has already been banned, and in advanced countries, also hydrochlorofluorocarbons such as R225 are expected to be totally banned in 2020. Further, PFC is a substance regulated by Kyoto Protocol for prevention of global warming. Further, R225 presents a high solubility to a synthetic resin and has had a problem such that when R225 is used for washing an article made of a synthetic resin, whitening or cracking is likely to result. Tridecafluorohexane presents a low solubility to an organic chemical substance.

It is an object of the present invention to provide a lubricant solution employing a solvent which has a performance equal to such R113, R225 or PFC without presenting adverse effects to the global environment and which presents an excellent solubility to a lubricant and little influence to a synthetic resin.

DISCLOSURE OF THE INVENTION

The present invention provides a lubricant solution comprising a lubricant and a solvent containing a nonafluorohexane.

Further, the present invention provides a method for coating a lubricant, which comprises coating a lubricant solution comprising a lubricant and a solvent containing a nonafluorohexane, on a substrate, and evaporating the solvent.

As a result of an extensive study, the present inventors have found it possible to use a nonafluorohexane as a solvent for diluting a lubricant.

BEST MODE FOR CARRYING OUT THE INVENTION

The nonafluorohexane in the present invention is a compound represented by the molecular formula $C_6F_9H_5$. The nonafluorohexane provides an excellent solubility to a lubricant and has a merit such that when contacted with a substrate made of a synthetic resin, it presents no influence over the substrate. Among them, 1,1,1,2,2,3,3,4,4-nonafluorohexane i.e. $CF_3(CF_2)_3CH_2CH_3$ (hereinafter referred to as HFC-569) is particularly preferred, since it is particularly excellent in the solubility of a lubricant. Further, nonafluorohexanes may be used alone or in combination as a mixture of two or more of them.

The lubricant solution of the present invention may further contain, as a solvent, 1,1,1,2,2,3,3,4,4,5,5,6,6-tridecafluorohexane (hereinafter referred to as HFC-5213). HFC-5213 is preferred in that it presents no influence over a substrate made of a synthetic resin such as an acrylic resin or a polycarbonate resin.

In a case where HFC-5213 is contained as a solvent, the content of the nonafluorohexane is preferably from 5 to 95 parts by mass, more preferably from 1 to 9 parts by mass, particularly preferably from 2 to 8 parts by mass, per 100 parts by mass of the total amount of the nonafluorohexane and HFC-5213.

In the present invention, the content of the nonafluorohexane in the solvent is preferably at least 80 mass % , more preferably at least 90 mass % , based on the total amount of the solvent. However, in a case where the solvent further contains HFC-5213, the content of the sum of the nonafluorohexane and HFC-5213 is preferably at least 80 mass % , more preferably at least 90 mass % , based on the total amount of the solvent.

Further, in the lubricant solution of the present invention, various other components may be incorporated as solvents, depending upon various purposes. For example, in order to increase the dissolving power or to adjust the evaporation rate, organic solvents other than HFC-5213 (hereinafter referred to as other organic solvents) may further be contained. A preferred example of such an organic solvent may be at least one member selected from the group consisting of hydrocarbons, alcohols, ketones, halogenated hydrocarbons (excluding the nonafluorohexane and HFC-5213), ethers and esters.

In the present invention, in a case where the solvent contains other organic solvents, the content of such other organic solvents in the total amount of the solvent is preferably at most 20 mass % , more preferably at most 10 mass % .

The lower limit of the content of other organic solvents is the minimum amount whereby the object of adding such other organic solvents is accomplished. Usually, such a minimum amount is at least 0.1 mass % based on the total amount of the solvent composition. In a case where an azeotropic composition is present in the solvent of the present invention, it is preferred to use the solvent in the form of the azeotropic composition.

Now, specific examples of the organic solvents which can be added as solvents in the present invention will be given.

As the hydrocarbon, a $C_{5-15}$ chain-structured or cyclic saturated or unsaturated hydrocarbon is preferred, and it may, for example, be n-pentane, 2-methylbutane, n-hexane, 2-methylpentane, 2,2-dimethylbutane, 2,3-dimethylbutane, n-heptane, 2-methylhexane, 3-methylhexane, 2,4-dimethylpentane, n-octane, 2-methylheptane, 3-methylheptane, 4-methylheptane, 2,2-dimethylhexane, 2,5-dimethylhexane, 3,3-dimethylhexane, 2-methyl-3-ethylpentane, 3-methyl-3-ethylpentane, 2,3,3-trimethylpentane, 2,3,4-trimethylpentane, 2,2,3-trimethylpentane, 2-methylheptane, 2,2,4-trimethylpentane, n-nonane, 2,2,5-trimethylhexane, n-decane, n-dodecane, 1-pentene, 2-pentene, 1-hexene, 1-octene, 1-nonene, 1-decene, cyclopentane, methylcyclopentane, cyclohexane, methylcyclohexane, ethylcyclohexane, bicyclohexane, cyclohexane, α-pinene, dipentene, decalin, tetralin or amylnaphthalene. More preferred is n-pentane, cyclopentane, n-hexane, cyclohexane or n-heptane.

As the alcohol, a $C_{1-16}$ chain-structured or cyclic saturated or unsaturated alcohol is preferred, and it may, for example, be methanol, ethanol, n-propyl alcohol, isopropyl alcohol, n-butyl alcohol, sec-butyl alcohol, isobutyl alcohol, tert-butyl alcohol, 1-pentanol, 2-pentanol, 1-ethyl-1-propanol, 2-methyl-1-butanol, 3-methyl-1-butanol, 3-methyl-2-butanol, neopentyl alcohol, 1-hexanol, 2-methyl-1-pentanol, 4-methyl-2-pentanol, 2-ethyl-1-butanol, 1-heptanol, 2-heptanol, 3-heptanol, 1-octanol, 2-octanol, 2-ethyl-1-hexanol, 1-nonanol, 3,5,5-trimethyl-1-hexanol, 1-decanol, 1-undecanol, 1-dodecanol, allyl alcohol, propargyl alcohol, benzyl alcohol, cyclohexanol, 1-methylcyclohexanol, 2-methylcyclohexanol, 3-methylcyclohexanol, 4-methylcyclohexanol, α-terpineol, 2,6-dimethyl-4-heptanol, nonyl alcohol or tetradecyl alcohol. More preferred is methanol, ethanol or isopropyl alcohol.

As the ketone, a $C_{3-9}$ chain-structured or cyclic saturated or unsaturated ketone is preferred. Specifically, it may, for example, be acetone, methyl ethyl ketone, 2-pentanone, 3-pentanone, 2-hexanone, methyl isobutyl ketone, 2-heptanone, 3-heptanone, 4-heptanone, diisobutyl ketone, mesityl oxide, phorone, 2-octanone, cyclohexanone, methylcyclohexanone, isophorone, 2,4-pentanedione, 2,5-hexanedione, diacetone alcohol or acetophenone. More preferred is acetone or methyl ethyl ketone.

As the halogenated hydrocarbon, a $C_{1-6}$ saturated or unsaturated chloro- or chlorofluoro-hydrocarbon is preferred, and it may, for example, be methylene chloride, 1,1-dichloroethane, 1,2-dichloroethane, 1,1,2-trichloroethane, 1,1,1,2-tetrachloroethane, 1,1,2,2-tetrachloroethane, pentachloroethane, 1,1-dichloroethylene, 1,2-dichloroethylene, trichloroethylene, tetrachloroethylene, 1,2-dichloropropane, dichloropentafluoropropane, dichlorofluoroethane or decafluoropentane. More preferred is methylene chloride, 1,2-dichloroethane or trichloroethylene.

As the ether, a $C_{2-8}$ chain-structured or cyclic saturated or unsaturated ether is preferred, and it may, for example, be diethyl ether, dipropyl ether, diisopropyl ether, dibutyl ether, ethyl vinyl ether, butyl vinyl ether, anisole, phenetole, methyl anisole, dioxane, furan, methyl furan or tetrahydrofuran. More preferred is diethyl ether, diisopropyl ether, dioxane or tetrahydrofuran.

As the ester, a $C_{2-19}$ chain-structured or cyclic saturated or unsaturated ester is preferred. Specifically, it may, for example, be methyl formate, ethyl formate, propyl formate, butyl formate, isobutyl formate, pentyl formate, methyl acetate, ethyl acetate, propyl acetate, isopropyl acetate, butyl acetate, isobutyl acetate, sec-butyl acetate, pentyl acetate, methoxybutyl acetate, sec-hexyl acetate, 2-ethylbutyl acetate, 2-ethylhexyl acetate, cyclohexyl acetate, benzyl acetate, methyl propionate, ethyl propionate, butyl propionate, methyl butyrate, ethyl butyrate, butyl butyrate, isobutyl isobutyrate, ethyl 2-hydroxy-2-methylpropionate, methyl benzoate, ethyl benzoate, propyl benzoate, butyl benzoate, benzyl benzoate, γ-butyrolactone, diethyl oxalate, dibutyl oxalate, dipentyl oxalate, diethyl malonate, dimethyl maleate, diethyl maleate, dibutyl maleate, dibutyl tartarate, tributyl citrate, dibutyl sebacate, dimethyl phthalate, diethyl phthalate or dibutyl phthalate. More preferred is methyl acetate or ethyl acetate.

In the present invention, the lubricant may be in the form of either liquid or solid. Specifically, the lubricant may, for example, be a fluorinated lubricant such as fluorinated oil, fluorinated grease or a resin powder of polytetrafluoroethylene, or a silicon lubricant such as silicon oil or silicon grease. The solvent containing the nonafluorohexane presents an excellent solubility or dispersibility to such a lubricant.

The content of the lubricant in the lubricant solution of the present invention is preferably from 0.01 to 50 mass % , more preferably from 0.05 to 30 mass % , particularly preferably from 0.1 to 20 mass % , with a view to bringing the coating thickness of the lubricant or the layer thickness after coating the lubricant solution within a proper range.

The lubricant solution of the present invention can be coated on various substrates. For example, it can be coated on various substrates made of e.g. metal, synthetic resin, glass and ceramics. Among them, with respect to a substrate made of a synthetic resin such as an acrylic resin or a polycarbonate resin, there has been a problem that cracking or whitening is likely to result depending upon the type of the solvent contained in the coated lubricant solution. However, when the lubricant solution of the present invention is employed, there is a merit that such a problem will not result.

Further, the lubricant solution of the present invention has a low viscosity and a low surface tension, whereby it can be coated thinly and uniformly on the surface of a substrate made of metal.

After coating the lubricant solution of the present invention, the solvent in the lubricant solution is evaporated, whereby only the lubricant will remain at the coated portion.

EXAMPLES

Examples 1 to 14

Solvents containing HFC-569 as an effective component, as shown in Examples 1 to 14 in Table 1, were, respectively, mixed with a fluorinated oil having a perfluoroalkyl group, as a lubricant, to prepare 14 lubricant solutions in which the content of the above fluorinated oil was 0.5 mass % . Each lubricant solution was coated on the surface of an aluminum-vapordeposited plate having aluminum vapordeposited on a plate made of iron, followed by air drying the solvent, to form a lubricant coating film on the surface of the aluminum-vaoprdeposited plate. The drying property of the solvent at that time, and the state of the obtained coating film, were visually observed. The results are shown in Table 1.

Evaluation of the "State of the coating film" in Table 1 was represented by ◎: good coating film, ○: fairly good coating film, Δ: irregularities partially observed, and X: substantial irregularities observed. Further, evaluation of the "Drying property" was represented by ◎: immediately dried, ○: dried in 10 minutes, Δ: dried in one hour, and X: not dried in one hour. Further, the numerical values in the brackets in the column for the solvent, represent the blend ratio (based on mass) of the two types of solvents. For example, with respect to Example 2, they represent that the blend ratio of HFC-569 to n-heptane is HFC-569/n-heptane=95/5.

TABLE 1

| Ex. No. | Solvent | State of the coating film | Drying property |
|---|---|---|---|
| 1 | HFC-569(100) | ◎ | ◎ |
| 2 | HFC-569(95)/n-heptane(5) | ◎ | ◎ |
| 3 | HFC-569(95)/ethanol(5) | ◎ | ◎ |
| 4 | HFC-569(95)/acetone(5) | ◎ | ◎ |
| 5 | HFC-569(90)/methylene chloride(10) | ◎ | ◎ |
| 6 | HFC-569(95)/diethyl ether(5) | ◎ | ◎ |
| 7 | HFC-569(99)/ethyl acetate(1) | ◎ | ◎ |
| 8 | HFC-569(50)/HFC-5213(50) | ◎ | ◎ |
| 9 | HFC-569(47.5)/HFC-5213(47.5)/n-heptane(5) | ◎ | ◎ |
| 10 | HFC-569(47.5)/HFC-5213(47.5)/ethanol(5) | ◎ | ◎ |
| 11 | HFC-569(47.5)/HFC-5213(47.5)/acetone(5) | ◎ | ◎ |
| 12 | HFC-569(45)/HFC-5213(45)/methylene | ◎ | ◎ |

TABLE 1-continued

| Ex. No. | Solvent | State of the coating film | Drying property |
|---|---|---|---|
| | chloride(10) | | |
| 13 | HFC-569(47.5)/HFC-5213(47.5)/diethyl ether(5) | ◎ | ◎ |
| 14 | HFC-569(47.5)/HFC-5213(47.5)/ethyl acetate(5) | ◎ | ◎ |

Examples 15 to 28

Solvents containing HFC-569 as an effective component, as shown in Examples 15 to 28 in Table 2, were, respectively, mixed with a silicon oil made of a polyalkyl siloxane, as a lubricant, to prepare 14 lubricant solutions wherein the content of the above fluorinated lubricant was 3 mass % .

Each lubricant solution was coated on the surface of a stainless steel plate, and the solvent was air-dried to form a lubricant coating film on the surface of the stainless steel plate. The drying property of the solvent at that time and the state of the obtained coating film were visually observed. The results are shown in Table 2.

Evaluation of the "State of the coating film" and the "Drying property" in Table 2, was carried out in the same manners as in Examples 1 to 14. Further, the numerical values in the brackets in the column for the solvent, represent the blend ratio (based on mass) of the two types of solvents.

TABLE 2

| Ex. No. | Solvent | State of the coating film | Drying property |
|---|---|---|---|
| 15 | HFC-569(100) | ◎ | ◎ |
| 16 | HFC-569(95)/n-heptane(5) | ◎ | ◎ |
| 17 | HFC-569(95)/ethanol(5) | ◎ | ◎ |
| 18 | HFC-569(95)/acetone(5) | ◎ | ◎ |
| 19 | HFC-569(90)/methylene chloride(10) | ◎ | ◎ |
| 20 | HFC-569(95)/diethyl ether(5) | ◎ | ◎ |
| 21 | HFC-569(99)/ethyl acetate(1) | ◎ | ◎ |
| 22 | HFC-569(50)/HFC-5213(50) | ◎ | ◎ |
| 23 | HFC-569(47.5)/HFC-5213(47.5)/n-heptane(5) | ◎ | ◎ |
| 24 | HFC-569(47.5)/HFC-5213(47.5)/ethanol(5) | ◎ | ◎ |
| 25 | HFC-569(47.5)/HFC-5213(47.5)/acetone(5) | ◎ | ◎ |
| 26 | HFC-569(45)/HFC-5213(45)/methylene chloride(10) | ◎ | ◎ |
| 27 | HFC-569(47.5)/HFC-5213(47.5)/diethyl ether(5) | ◎ | ◎ |
| 28 | HFC-569(47.5)/HFC-5213(47.5)/ethyl acetate(5) | ◎ | ◎ |

Examples 29 to 42

Solvents containing HFC-569 as an effective component, as shown in Examples 29 to 42 in Table 3, were mixed with a fluorinated lubricant comprising a polytetrafluoroethylene powder having a particle size of from 0.1 to 100 μm and a perfluoropolyether oil, to prepare 14 lubricant solutions wherein the content of the above fluorinated lubricant was 2 mass % .

Each lubricant solution was coated on the surface of a polycarbonate plate, and the solvent was air-dried to form a lubricant coating film on the surface of the polycarbonate plate. The drying property of the solvent at that time and the state of the obtained coating film were visually observed. The results are shown in Table 3.

Evaluation of the "State of the coating film" and the "Drying property" in Table 3, was carried out in the same manners as in Examples 1 to 14. Further, the numerical values in the brackets in the column for the solvent, represent the blend ratio (based on mass) of the two types of solvents.

TABLE 3

| Ex. No. | Solvent | State of the coating film | Drying property |
|---|---|---|---|
| 29 | HFC-569(100) | ◎ | ◎ |
| 30 | HFC-569(95)/n-heptane(5) | ◎ | ◎ |
| 31 | HFC-569(95)/ethanol(5) | ◎ | ◎ |
| 32 | HFC-569(95)/acetone(5) | ◎ | ◎ |
| 33 | HFC-569(90)/methylene chloride(10) | ◎ | ◎ |
| 34 | HFC-569(95)/diethyl ether(5) | ◎ | ◎ |
| 35 | HFC-569(99)/ethyl acetate(1) | ◎ | ◎ |
| 36 | HFC-569(50)/HFC-5213(50) | ◎ | ◎ |
| 37 | HFC-569(47.5)/HFC-5213(47.5)/n-heptane(5) | ◎ | ◎ |
| 38 | HFC-569(47.5)/HFC-5213(47.5)/ethanol(5) | ◎ | ◎ |
| 39 | HFC-569(47.5)/HFC-5213(47.5)/acetone(5) | ◎ | ◎ |
| 40 | HFC-569(45)/HFC-5213(45)/methylene chloride(10) | ◎ | ◎ |
| 41 | HFC-569(47.5)/HFC-5213(47.5)/diethyl ether(5) | ◎ | ◎ |
| 42 | HFC-569(47.5)/HFC-5213(47.5)/ethyl acetate(5) | ◎ | ◎ |

Examples 43 to 48

In the solvent shown in the following Table 4, an acrylic resin (shown by Acryl in Table 4) and a polycarbonate resin (shown as Polyca in Table 4) were immersed at room temperature for 24 hours and then withdrawn, whereupon the change in the appearance of the resins was observed. Evaluation of the appearance was represented by ◎: no change observed, Δ: slight whitening or dissolution observed, and X: whitening, cracking or dissolution observed. The results are shown in Table 4. The numerical values in the brackets in the column for the solvent, represent the blend ratio (based on mass) of the two types of solvents.

Example 49

Comparative Example

Using R225, the same test as in Examples 43 to 48 was carried out, whereby the change in the appearance of the resins was observed. The results are shown in Table 4.

TABLE 4

| Ex. No. | Solvent | Acryl | Polyca |
|---|---|---|---|
| 43 | HFC-569(100) | ◎ | ◎ |
| 44 | HFC-569(95)/n-heptane(5) | ◎ | ◎ |
| 45 | HFC-569(95)/ethanol(5) | ◎ | ◎ |
| 46 | HFC-569(50)/HFC-5213(50) | ◎ | ◎ |
| 47 | HFC-569(47.5)/HFC-5213(47.5)/n-heptane(5) | ◎ | ◎ |
| 48 | HFC-569(47.5)/HFC- | ◎ | ◎ |

TABLE 4-continued

| Ex. No. | Solvent | Acryl | Polyca |
|---|---|---|---|
| 49 | 5213(47.5)/ethanol(5) R225(100) | X | X |

Examples 50 to 52

To solvents containing HFC-569 as an effective component, as shown in Examples 50 to 52 in the following Table 5, silicon oil KF-96-50CS (product name, manufactured by Shinetsu Silicon Co., Ltd.) made of a polyalkyl siloxane was mixed so that it would be 0.1 mass % , the temperature was maintained at 30° C., and the mixture was shaked from time to time, whereby the sate of dissolution was visually observed. The evaluation results are shown in Table 5.

Evaluation of the appearance was represented by ◎: uniformly and transparently dissolved, Δ: slight turbidity observed, and X: separation into two layers or substantial turbidity observed. The numerical values in the brackets in the column for the solvent, represent the blend ratio (based on mass) of the two types of solvents Example 53

Comparative Example

Using HFC-5213, the same test as in Examples 50 to 52 was carried out. The evaluation results are shown in Table 5.

TABLE 5

| Ex. No. | Solvent | State of the coating film |
|---|---|---|
| 50 | HFC-569(100) | ◎ |
| 51 | HFC-569(95)/n-heptane(5) | ◎ |
| 52 | HFC-569(95)/ethanol(5) | ◎ |
| 53 | HFC-5213(100) | X |

As is evident from the Examples, the lubricant solution of the present invention is excellent in the diluting property and the drying property, whereby no irregularities of the coating film are observed. Further, it has a proper dissolving power like R113, R225 or PFC which has heretofore been used and can be applied to a composite component made of metal, plastic, elastomer, etc. without presenting adverse effects thereto.

INDUSTRIAL APPLICABILITY

The lubricant solution of the present invention can be coated on a predetermined portion of an instrument in the production of various types of instruments. For example, it can be applied to e.g. a rotary portion, a gear portion or a friction surface, such as a rotor portion of a motor, the surface of a hard disk, a bearing, a camera component such as a rotary portion of a lens for auto focus or a rotary portion for winding up a film, a gear component for a copy machine such as a roll or a scanning portion, or a computer component such as a gear of a tray portion of CD or DVD.

The entire disclosures of Japanese Patent Application No. 2002-179907 filed on Jun. 20, 2002 and Japanese Patent Application No. 2002-179908 filed on Jun. 20, 2002 including specifications, claims and summaries are incorporated herein by reference in their entireties.

The invention claimed is:

1. A lubricant solution comprising a fluorinated lubricant or a silicone lubricant and a solvent comprising 1,1,1,2,2,3,3,4,4-nonafluorohexane (HFC-569), wherein the content of the 1,1,1,2,2,3,3,4,4-nonafluorohexane (HFC-569) in the solvent is at least 80 mass %.

2. The lubricant solution of claim 1, which further comprises 1,1,1,2,2,3,3,4,4,5,5,6,6-tridecafluorohexane (HFC-5213).

3. The lubricant solution of claim 1, which comprises the fluorinated lubricant.

4. The lubricant solution of claim 1, which comprises the silicone lubricant.

5. The lubricant solution of claim 2, wherein the content of the 1,1,1,2,2,3,3,4,4-nonafluorohexane (HFC-569)is from 5 to 95 parts by mass per 100 parts by mass of the total amount of the 1,1,1,2,2,3,3,4,4-nonafluorohexane (HFC-569) and the 1,1,1,2,2,3,3,4,4,5,5,6,6-tridecafluorohexane (HFC-5213).

6. The lubricant solution of claim 1, wherein the solvent further comprises at least one organic solvent selected from the group consisting of hydrocarbons, alcohols, ketones, halogenated hydrocarbons (excluding 1,1,1,2,2,3,3,4,4-nonafluorohexane (HFC-569) and 1,1,1,2,2,3,3,4,4-nonafluorohexane (HFC-569), ethers and esters.

7. The lubricant solution of claim 1, wherein the content of the lubricant is from 0.1 to 20 mass %, and the content of the solvent is from 80 to 99.9mass %.

8. The lubricant solution of claim 1, wherein the content of the 1,1,1,2,2,3,3,4,4-nonafluorohexane (HFC-569) in the solvent is at least 90 mass %.

9. The lubricant solution of claim 6, wherein the amount of the organic solvent in the total amount of solvent is at most 20 mass %.

10. The lubricant solution of claim 6, wherein the amount of the organic solvent in the total amount of solvent is at most 10 mass %.

11. The lubricant solution of claim 9, wherein the amount of the organic solvent in the total amount of solvent is at least 0.1 mass %.

12. The lubricant solution of claim 1, wherein the content of the lubricant in the lubricant solution is 0.01 to 50 mass %.

13. The lubricant solution of claim 1, wherein the content of the lubricant in the lubricant solution is 0.05 to 30 mass %.

14. The lubricant solution of claim 1, wherein the content of the lubricant in the lubricant solution is 0.1 to 20 mass %.

15. A method for coating a lubricant, which comprises coating the lubricant solution as defined in claim 1 on a substrate and evaporating the solvent.

16. The method of claim 15, wherein the substrate is made of a synthetic resin.

17. The method of claim 16, wherein the substrate is an acrylic resin or a polycarbonate resin.

* * * * *